US010287811B1

(12) United States Patent
Arimoto et al.

(10) Patent No.: US 10,287,811 B1
(45) Date of Patent: May 14, 2019

(54) WINDOW REGULATOR ASSEMBLY WITH CARRIER PLATE

(71) Applicant: Hi-Lex Controls, Inc., Rochester Hills, MI (US)

(72) Inventors: Shigeki Arimoto, Bloomfield Hills, MI (US); Ichiro Okuno, Rochester Hills, MI (US); Yohei Moriya, Rochester Hills, MI (US)

(73) Assignee: Hi-Lex Controls, Inc., Rochester Hills, MI (US)

( * ) Notice: Subject to any disclaimer, the term of this patent is extended or adjusted under 35 U.S.C. 154(b) by 0 days.

(21) Appl. No.: 15/833,047

(22) Filed: Dec. 6, 2017

(51) Int. Cl.

| | |
|---|---|
| ***E05F 11/38*** | (2006.01) |
| ***E05D 15/16*** | (2006.01) |
| *E05F 15/689* | (2015.01) |
| *E05F 11/48* | (2006.01) |

(52) U.S. Cl.
CPC ..... *E05D 15/165* (2013.01); *E05F 11/483* (2013.01); *E05F 11/485* (2013.01); *E05F 15/689* (2015.01); *E05Y 2900/55* (2013.01)

(58) Field of Classification Search
CPC .. E05D 15/165; E05Y 2900/55; E05F 11/483; E05F 11/485; E05F 15/689
USPC ..... 49/352
See application file for complete search history.

(56) References Cited

U.S. PATENT DOCUMENTS

| | | | | |
|---|---|---|---|---|
| 5,511,443 | A * | 4/1996 | Munekhoff | E05F 11/483 49/352 |
| 5,528,861 | A * | 6/1996 | Beyerlein | E05F 11/485 49/349 |
| 7,908,795 | B2 * | 3/2011 | Arimoto | E05F 11/382 49/352 |
| 8,881,457 | B2 | 11/2014 | Matsushita | |
| 8,943,750 | B2 * | 2/2015 | Twork, Jr. | E05F 11/385 49/352 |
| 10,030,430 | B2 * | 7/2018 | Muramatsu | E05F 11/483 |
| 10,041,284 | B2 * | 8/2018 | Yamamoto | E05F 15/689 |
| 2002/0139052 | A1 * | 10/2002 | Messiez | B60J 1/17 49/375 |
| 2007/0180773 | A1 * | 8/2007 | Fortin | E05F 11/485 49/352 |
| 2008/0005971 | A1 * | 1/2008 | Dickie | E05F 15/689 49/349 |
| 2009/0007494 | A1 * | 1/2009 | Pavlovic | E05F 11/382 49/349 |
| 2014/0007507 | A1 | 1/2014 | Umemura | |
| 2016/0047411 | A1 * | 2/2016 | Simonneau | F16C 1/265 49/352 |
| 2017/0292312 | A1 * | 10/2017 | Yokoyama | E05F 15/689 |

* cited by examiner

*Primary Examiner* — Jerry E Redman
(74) *Attorney, Agent, or Firm* — Brinks Gilson & Lione

(57) ABSTRACT

A window regulator assembly for moving a side window of a vehicle in an upward direction and in a downward direction along a guide rail, includes a carrier plate having a rail channel for movably engaging the guide rail. A first cable end pocket laterally offset from the rail channel is configured for receiving a cable end extending from a bottom end of the guide rail, and a separate second cable end pocket, likewise laterally offset from the rail channel, is configured for receiving a cable end extending from a top end of the guide rail. At a top end of the first cable end pocket in an installed position, the first cable end pocket is longitudinally delimited by a radial step having a depth of at most ½ of a width of the first cable end pocket.

17 Claims, 4 Drawing Sheets

WINDOW REGULATOR ASSEMBLY WITH CARRIER PLATE

FIELD OF THE INVENTION

The present application relates to a carrier plate for moving an automotive vehicle window along a single guide rail.

BACKGROUND

Window regulators for automotive vehicles can be manually operated, or can be driven by a powered actuator, most commonly using an electric motor. One type of window regulator uses a pulley arrangement having a metal cable wrapped around pulleys and a drum driven by an electric motor or by a manual crank arm. Window regulator mechanisms can still be categorized into a group which includes dual-rail and single-rail types. As customary for single-rail rear side windows, a single carrier plate engages the glass panel in two laterally offset locations. The carrier plate is typically driven along a single metal guide rail by the metal cable. Specifically, the actuator moves the cable about the pulley arrangement. The cable in turn moves the carrier plate to control the vertical motion of the window glass. The actuator may be located near the bottom of the guide rail. In other embodiments, the actuator is laterally offset from the guide rail.

In some versions of window regulators, the carrier plate includes structures to secure the ends of the cable in the carrier plate to form a cable loop. As the cable ends are spring-biased for reducing slack in the cable during operation, the assembly of the window regulator arrangement prior to installation can be difficult. In particular the insertion of the spring-biased cable ends into the carrier plate can be difficult, or the spring-biased cable ends may slip out of their respective cavities in the carrier plate.

SUMMARY

It is an objective of the present invention to facilitate a smooth assembly of the window regulator According to a first aspect of the present invention, a window regulator assembly for moving a side window of a vehicle in an upward direction and in a downward direction along a guide rail, includes a carrier plate having a rail channel for movably engaging the guide rail. A first cable end pocket laterally offset from the rail channel is configured for receiving a cable end extending from a bottom end of the guide rail, and a separate second cable end pocket, likewise laterally offset from the rail channel, is configured for receiving a cable end extending from a top end of the guide rail. At a top end of the first cable end pocket in an installed position, the first cable end pocket is longitudinally delimited by a radial step having a depth of at most ½ of a width of the first cable end pocket. For an even easier insertion of a cable end, the depth of the radial step may be at most ⅓ of the width of the first cable end pocket.

To prevent buckling of the spring-loaded cable end, the first cable end pocket may have side walls vaulting toward each other to leave a slot between the side walls that is narrower than the width of the first cable end pocket.

For enlarging an open cross-section for inserting the cable end, the side walls may extend along only a portion of the cable pocket remote from the step so that an end portion of the cable end pocket around the step is free of the side walls. In one embodiment, the side walls taper off toward the step.

As the first cable end pocket receives a cable end from the bottom of the guide rail, a first cable channel may extend downward from a bottom end of the first cable end pocket in the installed position, and the slot transitions into the first cable channel.

The opening cross-section for inserting a cable end with a cylindrical spring into the first cable end pocket preferably allows for an insertion angle of at most 15°. The insertion angle may even be smaller, for example at most 10°, or even at most 5°. This small insertion angle effects a self-alignment of the compression spring with the cable end pocket by mere pulling of the cable without requiring a difficult manipulation of the cable end.

For a secure placement of the cable end in the cable end pocket, the cable end includes an end stopper with an enlarged head and a cylindrical compression spring, wherein a combined length of the compression spring and the enlarged head is greater than the first pocket length. Thus, after insertion into the first cable pocket, the compression spring is under tension and holds the cable end in place.

The second cable end pocket is preferably laterally disposed between the first cable end pocket and the rail channel to align with a corresponding pulley arrangement on the guide rail. The second cable end pocket may be longitudinally offset from the first cable end pocket so that the first cable end pocket is disposed above the second cable end pocket in the installed position.

Unlike the first cable end pocket, the second cable end pocket may have an end wall at a bottom end in the installed position with a greater depth than the step of the first cable end pocket.

Like the first cable end pocket, the second end pocket may have side walls vaulting toward each other to leave a slot between the side walls that is narrower than the width of the second cable end pocket. The slot can widen between the side walls of the second cable end pocket toward the end wall for creating an open cross-section for inserting a second cable end with a cylindrical spring into the second cable end pocket. The opening cross-section of the second cable end pocket may only allow for an insertion angle of no less than 30°.

Further, the second cable end pocket may a shorter second pocket length than a first pocket length of the first cable end pocket. As the second cable end is inserted first, it is easy to manipulate. For further assembly and installation of the window regulator assembly, the shorter length of the second cable end pocket ensures a secure retention of the cable end by causing a greater spring compression than the greater length of the first cable end pocket.

For a space-saving arrangement on the carrier plate, the first cable end pocket and the second cable end pocket may be disposed at a lateral overlap and laterally offset from each other by less than a width of the first cable end pocket and of the second cable end pocket.

Further aspects of the invention are explained in greater detail below for a preferred illustrative embodiment with reference to the attached drawings. The drawings are provided for purely illustrative purposes and are not intended to limit the scope of the present invention.

DETAILED DESCRIPTION

Figure 1:
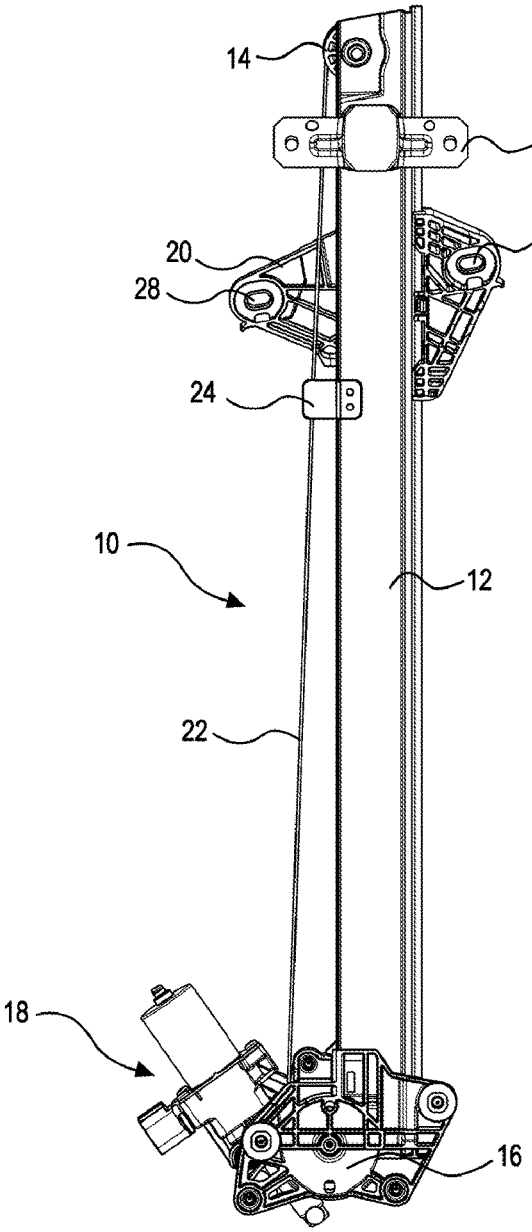
FIG. 1 is a perspective rail-side view of a window regulator assembly incorporating a cable guide in accordance with the present disclosure.
Figure 2:
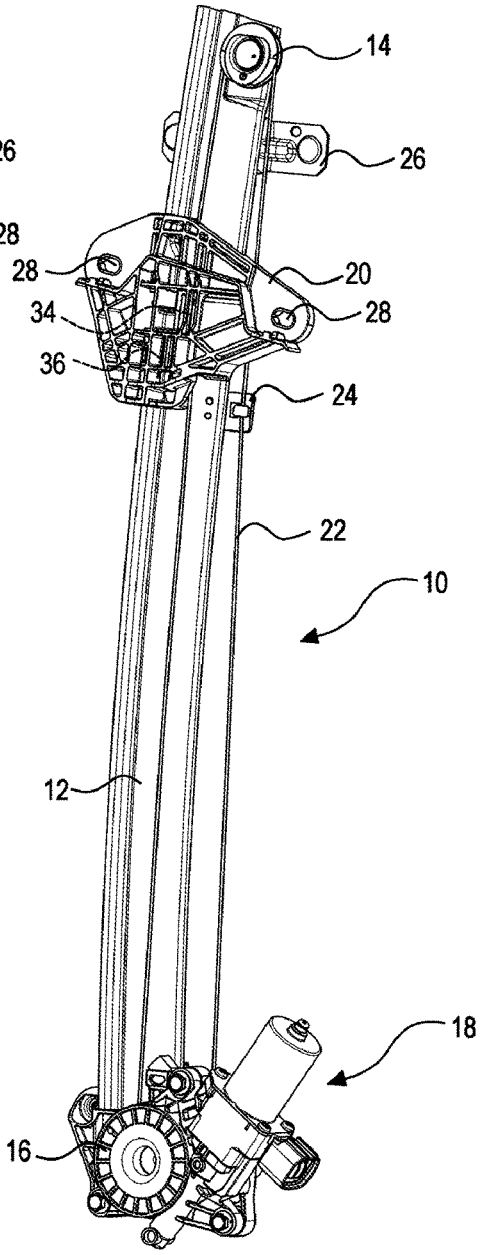
FIG. 2 is a perspective window-side view of the window regulator assembly of FIG. 1.

With reference to FIGS. 1 and 2, a window regulator assembly 10 includes as principal components, a guide rail 12, a top pulley 14, a bottom deflector 16 shown as a pulley, a motor drive assembly 18, a carrier plate 20, a cable 22, a cable guide clip 24, and a fastening bracket 26. While the shown embodiment includes only a single guide rail, the subsequently described details of the carrier plate 20 may also be implemented in carrier plates for dual-rail window regulator systems.

The guide rail 12 is formed of sheet-metal using a forming or rolling process or as an extrusion. The window carrier plate 20 is caused to travel up and down along the guide rail 12 and includes fastening structures 28 for window clamps for holding a lower edge of a glass panel. FIG. 1 shows the window regulator assembly viewed from the outside of a vehicle when installed. FIG. 2 shows the same window regulator assembly viewed from the inside of the vehicle.

The top pulley 16 is positioned at the top of the guide rail 12 and acts to redirect and tension the drive cable 22. In the shown example, the motor drive assembly 18 positioned at the bottom of the guide rail 12 near the bottom pulley 16 and is actuated and powered electrically to move the drive cable 22. The drive cable 22 starts and ends at the carrier plate 20 is guided around the top pulley 14 and the bottom pulley. An intermediate length of the drive cable 22 extends outside of the perimeter of the guide rail 12 through a cable guide clip 24 attached to the guide rail. The cable guide clip reduces noise and vibration of the intermediate length of the drive cable.

Ends 34 and 36 of the drive cable 22 are secured in a first cable end pocket 30 receiving the cable end extending upward from the bottom pulley 16, and in a second cable end pocket 32 receiving the cable end extending downward from the top pulley 14. The cable end pockets 32 and 34 face the guide rail 12 in the installed position shown in FIGS. 1 and 2. The cable end pockets 30 and 32 are shown in FIGS. 3 through 6 and are discussed below.

Figure 3:
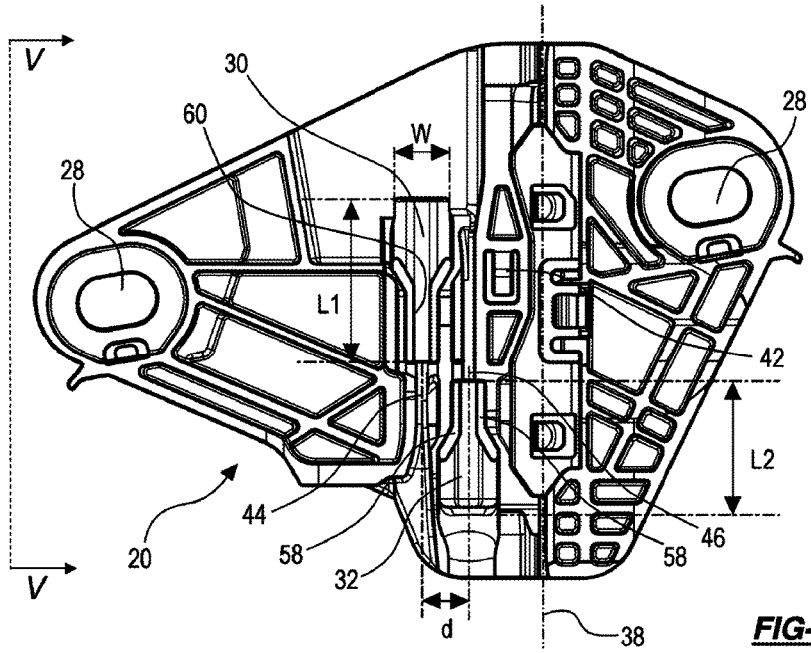
FIG. 3 is a rail-side view of the carrier plate of FIG. 1 without a rail.

Now referring to FIG. 3, the carrier plate 20 includes a rail channel 38 for a guide structure formed on the guide rail 12. In the shown embodiment, the rail channel 38 forms an L-shaped cross-sectional clearance 40 (see FIG. 4) corresponding to a corresponding L-shaped guide structure on the guide rail 12. Between the rail channel 38 and the cable end pockets 30 and 32, an elastic sliding tongue 42 protrudes from the carrier plate toward the vehicle outside, where the rail extends in the installed configuration. The elastic sliding tongue 42 reduces slack between the carrier plate 20 and the guide rail 12.

The first cable end pocket 30 for the cable end extending upward from the bottom pulley 16 is farther removed from the rail channel 38 than is the second cable end pocket 32. The first cable end pocket 30 has a first cable channel 44 extending downward toward the bottom pulley 16. The second cable end pocket 32 has a second cable channel 46 extending upward toward the top pulley 14. The second cable channel 46 extends between the first cable end pocket 30 and the elastic sliding tongue. While the cable end pockets 30 and 32 are disposed at different distances from the rail channel 38, the orientation of the drive cable 22 extending from each of the cable end pockets is parallel to the rail channel in the installed configuration due to the radii and axes of rotation of the top pulley 14 and the bottom pulley 16.

Also, the different distances, at which the cable end pockets 30 and 32 are laterally offset from the rail channel 38, are reduced by a generally nested arrangement, in which the cable end pockets 30 and 32 are also longitudinally offset from one another. In the shown arrangement, the first and second cable channels 44 and 46 overlap laterally, but the cable end pockets 30 and 32 only overlap with the cable exiting the respective other cable end pocket 32 and 30. This allows the cable end pockets 30 and 32 to overlap laterally such that the lateral distance d, corresponding the lateral offset between the center lines of the cable channels 44 and 46, is smaller than the width W of the first cable end pocket 30 and of the second cable end pocket 32. The first and second cable end pockets 30 and 32 have the same width W, they have different lengths L1 and L2. The length L1 of the first cable end pocket 30 is greater than the length L2 of the second cable end pocket 32. This will be discussed in greater detail below in connection with FIGS. 4-7.

Figure 4:
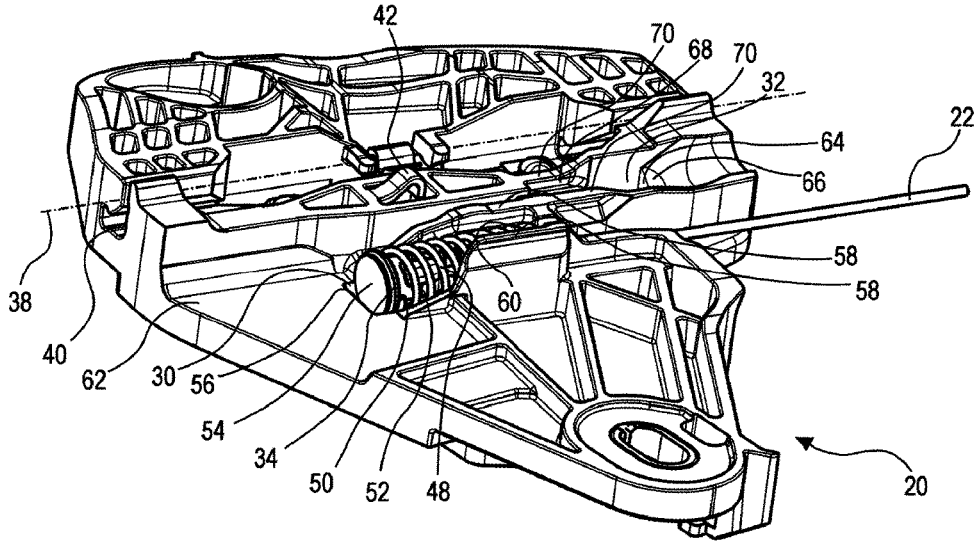
FIGS. 4, 5 and 6 are perspective rail side views of the carrier plate of FIG. 1 at different stages of inserting a cable end.

Now referring to FIG. 4, the first cable end pocket 30 is shown with the first cable end 34 installed. The second cable end 36, which is identical to the first cable end 34, has been omitted for simplicity.

The following description of the first cable end 34 applies in analogy to the second cable end 36. The first cable end 34 includes a cylindrical compression spring 48 and an end stopper 50 composed of a crimped ferrule 52 and a flat enlarged head 54, which is closed. The enlarged head 54 has a diameter that is about equal to an outer diameter of the compression spring 48. The flat end 54 is monolithically formed with the crimped ferrule and forms a radial collar supporting one end of the compression spring 48. The compression spring 48 has a relaxed length that, combined with the enlarged head 54 of the end stopper, is greater than the length L1 of the first cable end pocket (and thus also the length L2 of the second cable end pocket). Accordingly, in the shown installed position of the first cable end 34, the compression spring 48 is under tension inside the first cable end pocket 30.

Longitudinally adjacent to the enlarged head 54, the first cable end pocket 30 is longitudinally delimited by a step 56 abutted by the enlarged head 54 of the end stopper 50. The step 56 is at the top end of the first cable end pocket 30 in the installed position shown in FIGS. 1 and 2. The step 56 is raised above a deepest point P of the first cable end pocket by less than half of the diameter of the enlarged head 54 (see FIG. 7). In this context, the deepest point of the cable end pocket is the point most inward toward the passenger compartment of the vehicle because the top of FIG. 4 is the outward-facing side of the carrier plate 20. As the cable end pocket has a bottom adapted to the cylindrical shape of the compression spring 48, the deepest point P of the cable end pocket 30 is part of a lowest longitudinal line along the bottom of the cable end pocket 30. In one example, the depth of the step 56 may amount to no more than ⅓ of the diameter of the enlarged head 54 or of compression spring 48 above the deepest point P of the first cable end pocket 30. Assuming that the first cable end pocket 30 has a width W that is at least equal to the diameter of the compression spring 48, the step 56 has a depth that is at most ½ or ⅓ of the width W (see FIG. 3) of the first cable end pocket 30.

The step 56 separates the end of the first cable end pocket 30 from a planar portion 62 surrounding a stopper side end of the first cable end pocket 30. The planar portion 62 that has a height defined by the depth of step 56, is raised above the deepest point P of the first cable end pocket 30 by less than the bottom of the first cable channel 44. This will be discussed in more detail in connection with FIG. 7.

The step 56 does not cover the center of the enlarged head 54 of the end stopper so that the compression spring could possibly bend radially outward and escape from the first cable end pocket 30 without further restraints. In a section adjacent the first cable channel 44, the first cable end pocket 30 includes two side walls 58 (also shown in FIG. 3) that vault toward each other over the compression spring 48 to leave a slot 60 between them that is narrower than the diameter of the compression spring 48. Thus, while the compression spring 48 is visible through the slot 60, it cannot bulge upward through the slot.

The vaulted side walls 58 extend along about half of the length of the cable end pocket and end at a radial cable-side end wall 62 that extends on both lateral sides of the first cable channel 44. The slot 60 transitions into the first cable channel 44. The cable-side end wall 62 has a greater height than the diameter of the compression spring 48 and supports the entire circumference of the compression spring 48. Toward the step 56, the side walls 58 taper off so that a large open cross-section leading into the first cable end pocket 30 is created adjacent to the step 56. The taper ends short of the end of the first cable end pocket 30 so that an end portion of the first cable end pocket 30 around the step 56 is not flanked by side walls. It is within the scope of the present invention that, instead of being tapered toward the end stopper-side end of the first cable end pocket 30, the side walls 58 may simply be shorter than the first cable end pocket 30 without a taper. Either way, the open cross-section for inserting the first cable end 34 is enlarged, thereby easing the process of inserting the first cable end 34 into the first cable end pocket 30.

The second cable end pocket 32 is, in various aspects, similar to the first cable end pocket 30. However, it has an end wall 64 that is higher than the step 56 so that the end wall 64, apart from a small chamfer 66, covers the enlarged head of the second cable end 32. While the slot 68 between vaulted side walls of the second cable end pocket widens toward the end wall 64, the side walls 70 don't taper down so that the second cable end pocket receives the second cable end 36 in its entirety. Also, as previously mentioned, the second cable end pocket 32 is shorter than the first cable end pocket 30. Still, the deepest points and the cable channels 44 and 46 are at identical heights in the carrier plate 20.

As a result, the installation of the window regulator 10, especially the insertion of the cable ends 34 and 36 into the cable end pockets 30 and 32 is much easier than with known carrier plates as will be explained in connection with FIGS. 5 through 7. The second cable end 36 can initially be inserted into the second cable end pocket 32. Because the cable 22 is not under tension at this point, no specific accommodations for easy insertion need to be made as the cable end 36 can easily be manipulated.

Figure 5:
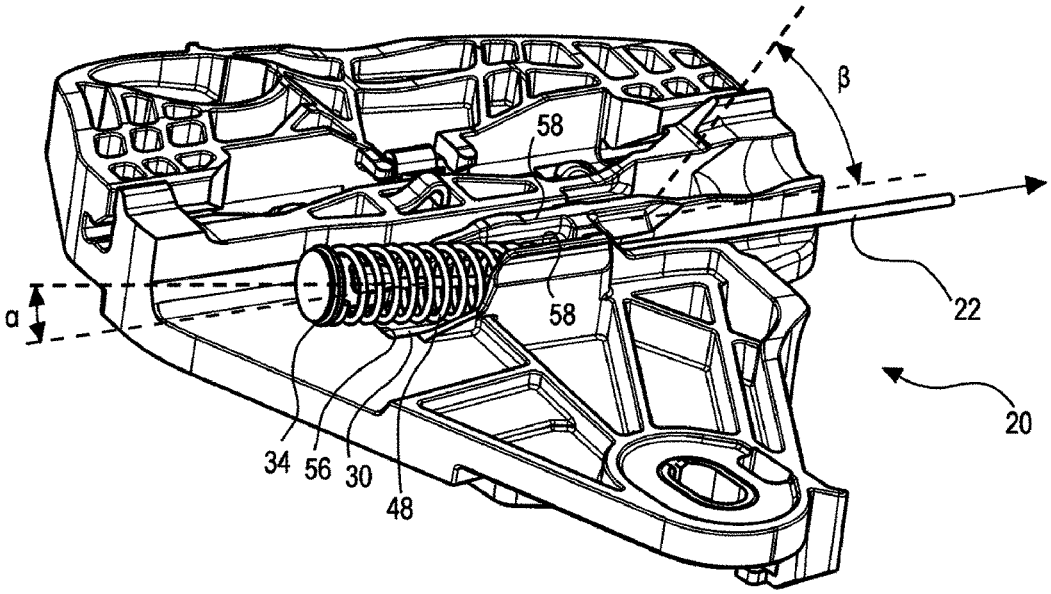
Figure 6:
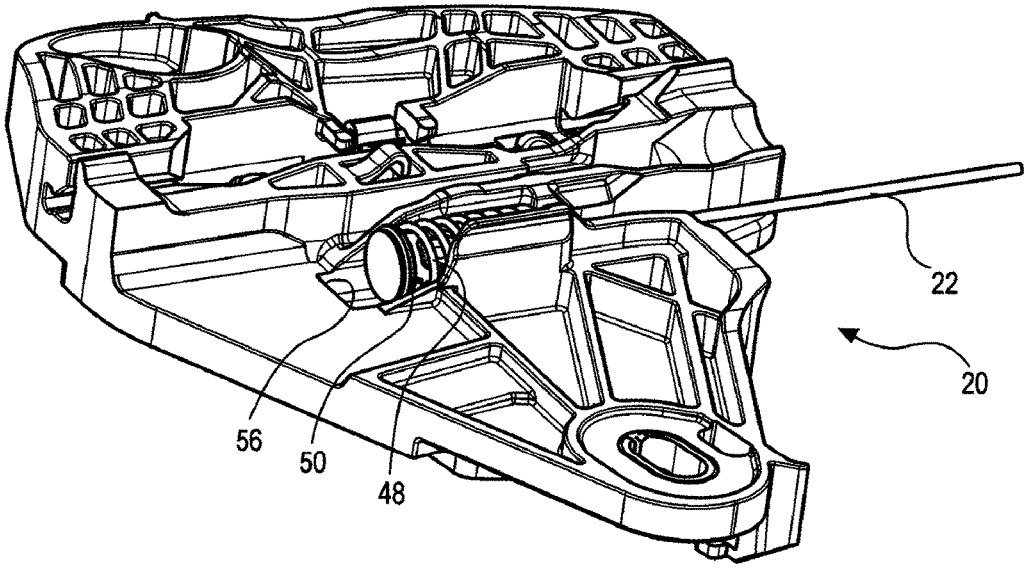

FIG. 5 shows the carrier plate 20 during the insertion of the first cable end 3434. This step is performed after the second cable end 36 in already in place. The second cable end 36 is only omitted for simplicity.

Because the step 56 has a height less than half of the outer diameter of the compression spring 48 and because the side walls 58 are tapered down toward the step 58, the wide open cross-section of the first cable end pocket 30 allows for a very shallow insertion angle α of the first cable end 34 compared to the insertion angle β for the second cable end 36.

The insertion angle is the smallest possible angle, at which the compression spring can be inserted into the cable end pocket relative to a carrier plane parallel to the guide rail in an installed position and parallel to the glass panel to be moved. For example, the fastening structures 28 are surrounded, on the side facing the inside of the passenger compartment, by planar portions 72 (see also FIG. 8) extending in a common plane parallel to the carrier plane.

Figure 7:
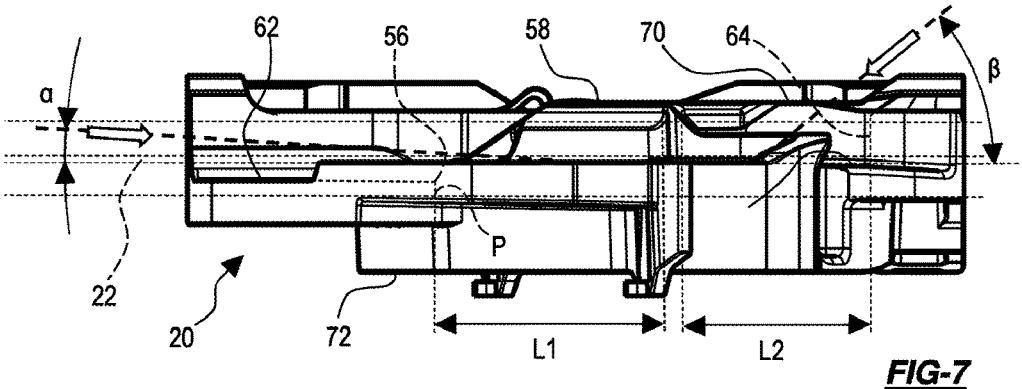
FIG. 7 is a lateral side view of the carrier plate of FIG. 1.

As shown in FIGS. 5 and 7, the first insertion angle α is no greater than about 15°, preferably no greater than 10°. In fact, in the shown example, the first insertion angle α amounts to at most 5°. This is a significant reduction compared to the second insertion angle β, which ranges between 30° and 45°.

For proper insertion of the first cable end 34 and for tensioning the compression spring 48, the cable 22 is placed in the first cable channel 44 so that the cable-side end of the compression spring 48 lies in the first cable end pocket 30 as shown in FIG. 5. A simple subsequent action for proper placement of the end stopper 50 and the first compression spring 48 consists of pulling the cable 22. Because the first insertion angle α is shallow and the opening cross-section is wide, the end stopper 50 and the first compression spring 48 align themselves with the first cable end pocket 30 and move into the position shown in FIG. 6, past the step 56. No manipulation of the end stopper 50 or the compression spring 48 is necessary. Furthermore, because the first cable end pocket 30 has a greater length L1 compared to the length L2 of the second cable pocket 32, a lesser pull force is required for achieving the necessary compression of the compression spring 48 to move the enlarged head 58 past the step 56.

A subsequent release of the cable 22 moves the end stopper 50 and the first compression spring 48 into the final installed position shown in FIG. 4.

FIG. 7 illustrates that the side walls 58 and 70 have the same maximum heights, but that the sides walls 58 taper off toward the step 56, while the side walls 70 don't taper off. The position of the cable 22 is illustrated in broken lines. The cable 22 exits both cable end pockets 30 and 32 at the same height. The end wall 64 is significantly higher than the step 56. Further indicated in broken lines are the different lengths L1 and L2 of the first and second cable end pockets 30 and 32.

Figure 8:
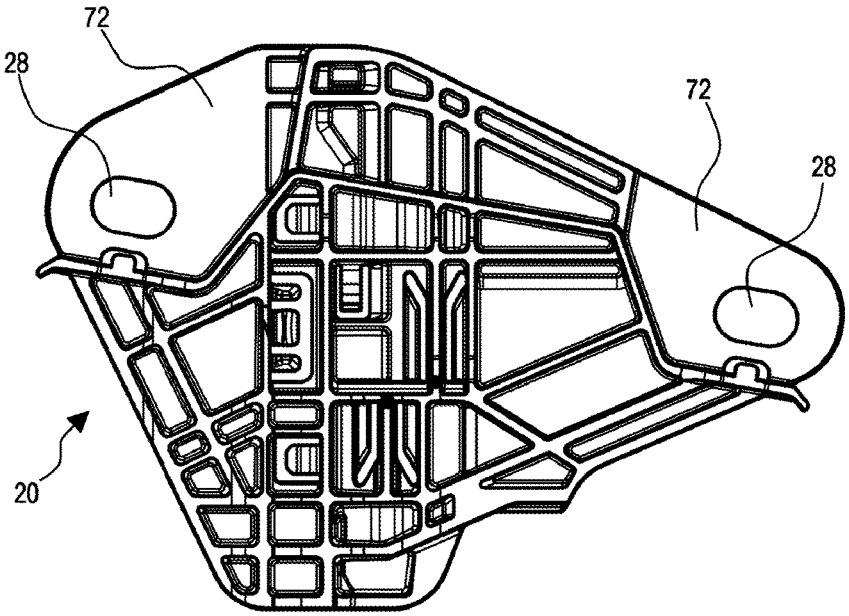
FIG. 8 is a window-side view of the carrier plate of FIG. 1 without a rail.

FIG. 8 shows the side of the carrier plate 20 that faces away from the guide rail 12 and toward the glass panel of the vehicle side window. On this side, tabs 74 are provided for retaining window clamps (not shown) to be attached to the fastening structures 28 for holding the glass panel.

While the above description constitutes the preferred embodiments of the present invention, it will be appreciated that the invention is susceptible to modification, variation and change without departing from the proper scope and fair meaning of the accompanying claims.

What is claimed is:

1. A window regulator assembly for moving a side window of a vehicle in an upward direction and in a downward direction along a guide rail, the window regulator comprising a carrier plate having a rail channel movably engaging the carrier plate with the guide rail, a first cable end pocket laterally offset from the rail channel and receiving a cable end extending from a bottom end of the guide rail, and a separate second cable end pocket laterally offset from the rail channel receiving a cable end extending from a top end of the guide rail, wherein at a top end of the first cable end pocket in an installed position, the first cable end pocket is longitudinally delimited by a radial step having a depth of at most ½ of a width of the first cable end pocket.

2. The window regulator assembly according to claim 1, wherein the depth of the radial step is at most ⅓ of the width of the first cable end pocket.

3. The window regulator assembly according to claim 1, wherein the first cable end pocket has a first pocket length, further comprising a drive cable with a cable end, the cable end including an end stopper with an enlarged head and a cylindrical compression spring, wherein a combined length of the compression spring and the enlarged head is greater than the first pocket length.

4. The window regulator assembly according to claim 1, wherein the second cable end pocket is laterally disposed between the first cable end pocket and the rail channel.

5. The window regulator assembly according to claim 4, wherein the second cable end pocket is longitudinally offset from the first cable end pocket such that the first cable end pocket is disposed above the second cable end pocket in the installed position.

6. The window regulator assembly according to claim 4, wherein the second cable end pocket has an end wall at a bottom end in the installed position, the end wall having a greater depth than the step of the first cable end pocket.

7. The window regulator assembly according to claim 6, wherein the second end pocket has side walls vaulted toward each other to leave a slot between the side walls that is narrower than the width of the second cable end pocket, the slot widening between the side walls of the second cable end pocket toward the end wall.

8. The window regulator assembly according to claim 7, wherein the end wall leaves an opening cross-section for inserting a cable end with a cylindrical spring into the second cable end pocket, wherein the opening cross-section allows for an insertion angle of no less than 30°.

9. The window regulator assembly according to claim 4, wherein the second cable end pocket has a shorter second pocket length than a first pocket length of the first cable end pocket.

10. The window regulator assembly according to claim 4, wherein the first cable end pocket and the second cable end pocket are disposed at a lateral overlap and are laterally offset from each other by less than a width of the first cable end pocket and of the second cable end pocket.

11. A window regulator assembly for moving a side window of a vehicle in an upward direction and in a downward direction along a guide rail, the window regulator comprising a carrier plate having a rail channel for movably engaging the carrier plate with the guide rail, a first cable end pocket laterally offset from the rail channel and configured for receiving a cable end extending from a bottom end of the guide rail, and a separate second cable end pocket laterally offset from the rail channel configured for receiving a cable end extending from a top end of the guide rail, wherein at a top end of the first cable end pocket in an installed position, the first cable end pocket is longitudinally delimited by a radial step having a depth of at most ½ of a width of the first cable end pocket, wherein the first cable end pocket has side walls vaulted toward each other to leave a slot between the side walls that is narrower than the width of the first cable end pocket.

12. The window regulator assembly according to claim 11, wherein the side walls extend along a portion of the cable pocket remote from the step, wherein an end portion of the first cable end pocket 30 around the step 56 is free of the side walls.

13. The window regulator assembly according to claim 11, wherein the side walls taper off toward the step.

14. The window regulator assembly according to claim 11, wherein the first cable end pocket has a first cable channel extending downward from a bottom end of the first cable end pocket in the installed position, wherein the slot transitions into the first cable channel.

15. The window regulator assembly according to claim 11, wherein the step leaves an opening cross-section for inserting a cable end with a cylindrical spring into the first cable end pocket, wherein the opening cross-section allows for an insertion angle of at most 15°.

16. The window regulator assembly according to claim 15, wherein the opening cross-section allows for an insertion angle of at most 10°.

17. The window regulator assembly according to claim 16, wherein the opening cross-section allows for an insertion angle of at most 5°.

* * * * *